US007303488B2

(12) United States Patent
Kakiuchi et al.

(10) Patent No.: US 7,303,488 B2
(45) Date of Patent: Dec. 4, 2007

(54) GOLF CLUB HEAD

(75) Inventors: Hisashi Kakiuchi, Kobe (JP); Masahide Onuki, Kobe (JP)

(73) Assignee: SRI Sports Limited, Kobe (JP)

( * ) Notice: Subject to any disclaimer, the term of this patent is extended or adjusted under 35 U.S.C. 154(b) by 275 days.

(21) Appl. No.: 10/998,549

(22) Filed: Nov. 30, 2004

(65) Prior Publication Data

US 2005/0124436 A1 Jun. 9, 2005

(30) Foreign Application Priority Data

Dec. 9, 2003 (JP) ..... 2003-410763

(51) Int. Cl.
*A63B 53/04* (2006.01)

(52) U.S. Cl. ..... 473/346; 473/345

(58) Field of Classification Search ..... 473/324–350
See application file for complete search history.

(56) References Cited

U.S. PATENT DOCUMENTS 5,004,241 A * 4/1991 Antonious ..... 473/327
6,074,310 A * 6/2000 Ota ..... 473/345

FOREIGN PATENT DOCUMENTS

| | | | |
|---|---|---|---|
| JP | 9-299519 A | | 11/1997 |
| JP | 10-33723 A | | 2/1998 |
| JP | 11-155982 A | | 6/1999 |
| JP | 2001-129131 A | | 5/2001 |
| JP | 2003047676 A | * | 2/2003 |

* cited by examiner

*Primary Examiner*—Eugene Kim
*Assistant Examiner*—Alvin A Hunter
(74) *Attorney, Agent, or Firm*—Birch, Stewart, Kolasch & Birch, LLP

(57) ABSTRACT

A hollow golf club head comprises: a face portion whose front face defines a club face for hitting a ball; a crown portion intersecting the club face at the upper edge thereof; and a sole portion intersecting the club face at the lower edge thereof, wherein at least one of the sole portion and the crown portion is provided along the front edge thereof with a face-backing zone in which the rigidity is gradually increased from its toe-side end and heel-side end toward the center thereof.

11 Claims, 8 Drawing Sheets

GOLF CLUB HEAD

BACKGROUND OF THE INVENTION

The present invention relates to a golf club head, more particularly to a face support structure suitable for a large-sized hollow head capable of improving rebound performance.

In recent years, in order to improve the rebound performance of golf club heads, various devices were made. In large-sized hollow wood-type club heads in particular, the mainstream tendency to decrease the thickness of the face portion partially or wholly. Such a, technique is widely employed together with light-weight tough metal materials such as titanium alloys. As a result, in the face portion, the thinning of the material thickness accelerated. On the other hand, wood-type clubs have tended towards a large-sized head. Thus other portions such as the sole portion, side portion and especially the crown portion, are also formed with reduced thicknesses. As the face portion is thin, the deflection at impact is increased and thereby the restitution coefficient is increased to improve the rebound performance.

In order to further improve the rebound performance, the inventors made a study on the relationship between the restitution coefficient and the deflection, and it was found that the rigidity of the part supporting the face portion, namely, the front end zones of the crown portion and sole portion largely affects the rebound performance. If the rigidity in such zones is excessively increased, the deflection decreases and the restitution coefficient is accordingly decreased. On the contrary, if the rigidity is excessively decreased, the deflection may be increased, but the restitution coefficient is again decreased. Further, as the strength decreases, the durability is greatly decreased. But then it was discovered that both the restitution coefficient and durability can be improved by gradually changing the rigidity in the front end zones in a special manner.

SUMMARY OF THE INVENTION

It is therefore, an object of the present invention to provide a golf club head in which the rebound performance and durability are both improved in a well-balanced manner.

According to the present invention, a hollow golf club head comprises a face portion whose front face defines a club face for hitting a ball, a crown portion intersecting the club face at the upper edge thereof, and a sole portion intersecting the club face at the lower edge thereof, wherein at least one of the sole portion and crown portion is provided along the front edge thereof with a face-backing zone in which the rigidity is gradually increased from its toe side end and heel-side end toward the center thereof.

Therefore, the face portion is provided with a periphery support suitable for improving the power of restitution. Thus, the rebound performance can be improved. Further, in the central portion where a larger stress is usually produced at impact, as the rigidity becomes larger, the stress is evened and the durability can be improved.

DESCRIPTION OF THE PREFERRED EMBODIMENTS

Figure 1:
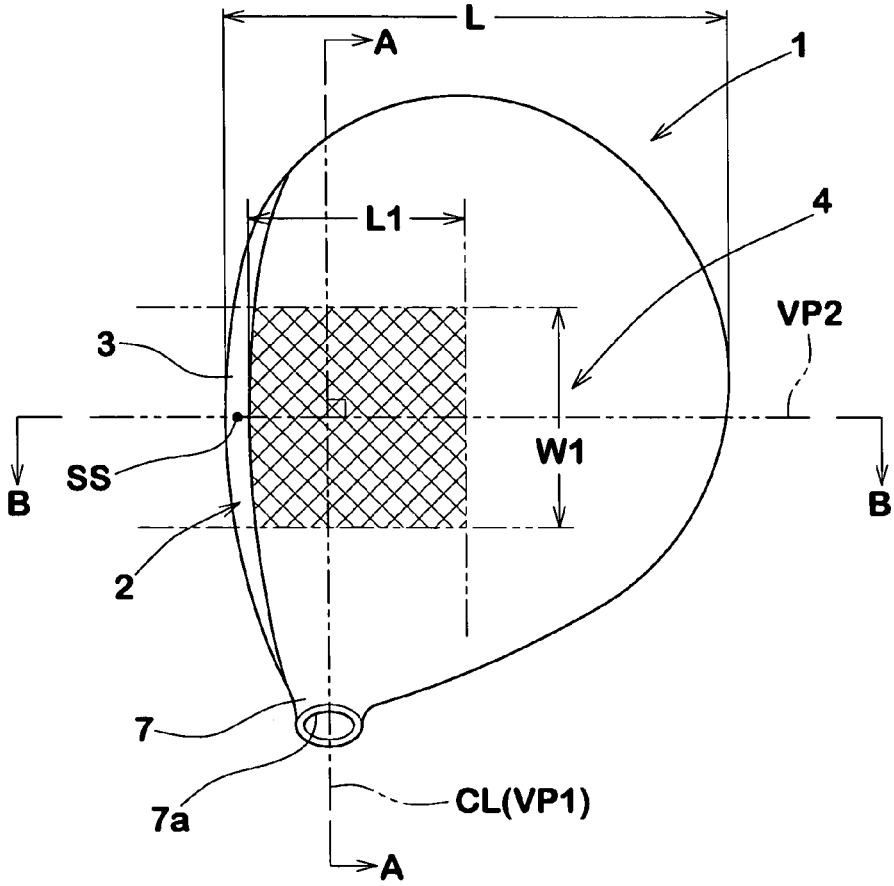
FIG. 1 is a top view of a wood-type golf club head according to the present invention.

Embodiments of the present invention will now be described in detail in conjunction with the accompanying drawings.

In the drawings, golf club head 1 according to the present invention is a wood-type hollow metal head (in this example, #1 driver) comprising: a face portion 3 whose front face defines a club face 2 for striking a ball; a crown portion 4 intersecting the club face 2 at the upper edge 2U thereof; a sole portion 5 intersecting the club face 2 at the lower edge 2L thereof; a side portion 6 between the crown portion 4 and sole portion 5 which extends from a toe-side edge to heel-side edge of the club face 2 through the back face of the club head; and a neck portion 7 to be attached to an end of a club shaft (not shown). The neck portion 7 is provided with a hose 17*a* or a circular hole for inserting the club shaft which extends towards the inside of the head from the above-mentioned opening. The center line of the shaft-inserting hole 7*a* can be used instead of the center line CL of the golf club shaft when setting up the golf club head alone in its standard or measuring state.

Here, the standard state is that the golf club head 1 is set on a horizontal plane HP such that the shaft center line CL inclines at the lie angle alpha while keeping the center line CL on a vertical plane VP1, and the club face 2 forms its loft angle beta with respect to the horizontal plane HP. In the drawings, such standard state is shown.

The volume of the club head 1 is set in a range of not less than 280 cc, preferably not less than 300 cc, more preferably not less than 320 cc, but preferably at most about 460 cc.

The club head 1 has a hollow (i) which is void in this example. But, a filler such as foamed plastic/resin or rubber may be disposed therein.

The club head 1 is made of one or more metal materials such as titanium alloys, stainless steels and aluminum alloys. But, if necessary, for instance for the purpose of weight reduction and the like, nonmetallic materials such as fiber reinforced resins or plastics may be included partially or as a major part of the head.

In the following embodiments, the club head 1 is formed by welding a face plate to a hollow main body which are made of a titanium alloy such as Ti-6Al-4V.

In order to achieve an increased deflection of the face portion 3, the maximum thickness of the face portion 3 is preferably limited in a range of from 1.8 to 3.0 mm, more preferably 2.1 to 2.9 mm, still more preferably 2.3 to 2.9 mm. In this embodiment, in order to further increase the deflection of the face portion 3 at impact without decreasing the durability and strength, the face portion 3 is provided with a thinner peripheral region 3P having a minimum thickness encircling a thicker central region 3C in which the above-mentioned maximum thickness occurs. The thicker central region 3C includes a sweet spot SS and has a shape which is, roughly speaking, an oval similar to the club face 2 long from side to side. The minimum thickness is preferably set in the range of from 1.3 to 2.7 mm. The difference between the maximum and minimum is preferably in the range of from 0.1 to 1.5 mm. From the central thick region 3C to the peripheral thinner region 3P, the thickness of the face portion is gradually or continuously changed.

The above-mentioned sweet spot SS is a point of intersection between the club face 2 and a straight line drawn perpendicularly to the club face passing the center of gravity of the golf club head.

According to the present invention, a variable-rigidity face-backing zone 4F, 5F is formed in the crown portion 4 or the sole portion 5 or both, preferably at least in the crown portion 4.

Figure 3:
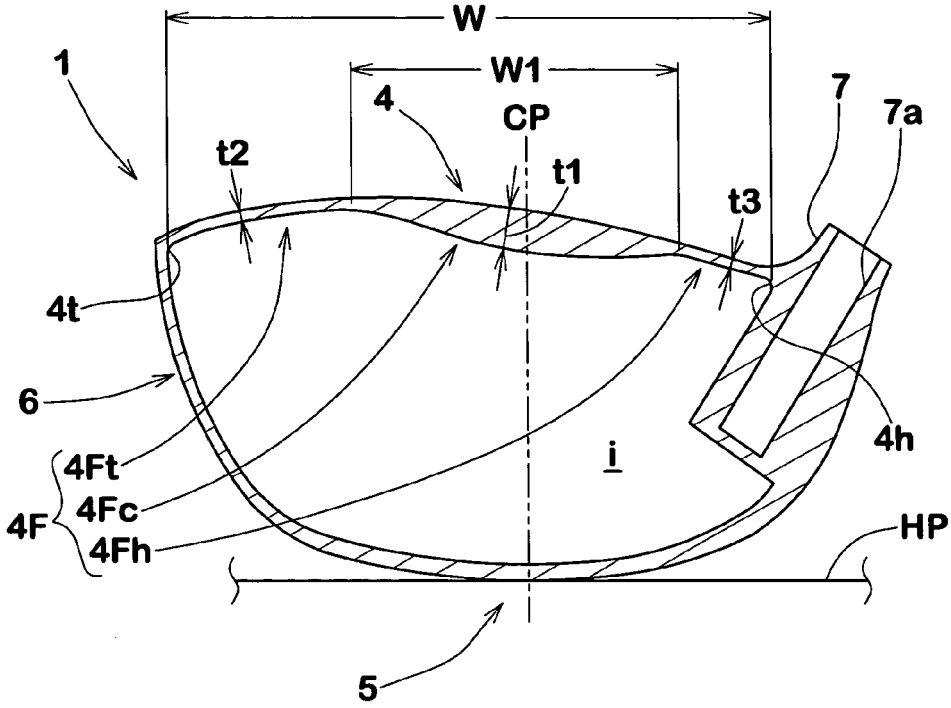
FIGS. 3 and 4 show a first embodiment of the present invention as cross sectional views taken along line A-A and line B-B in FIG. 1, respectively.
Figure 4:
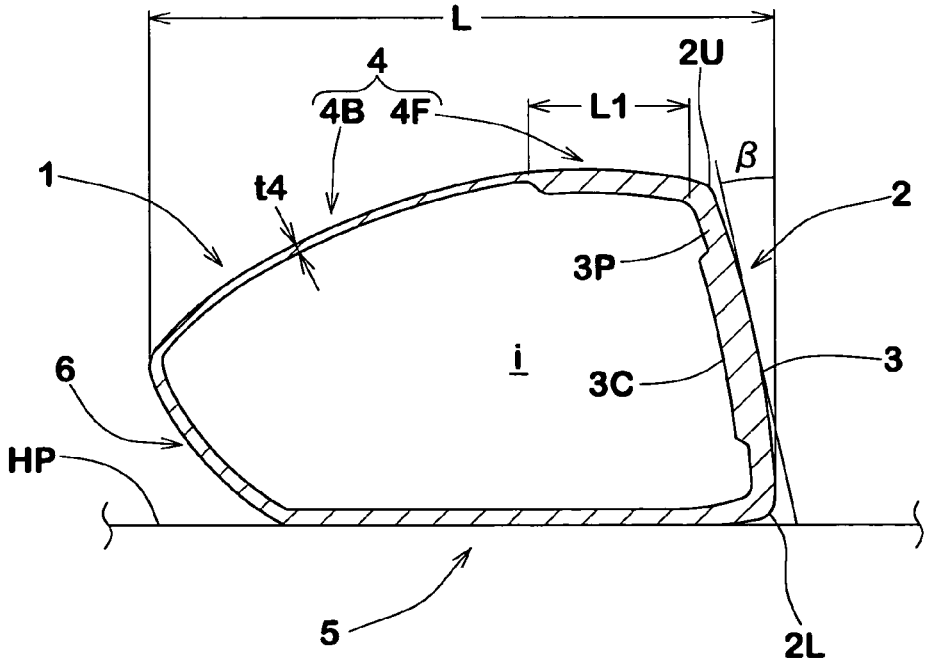
Figure 5:
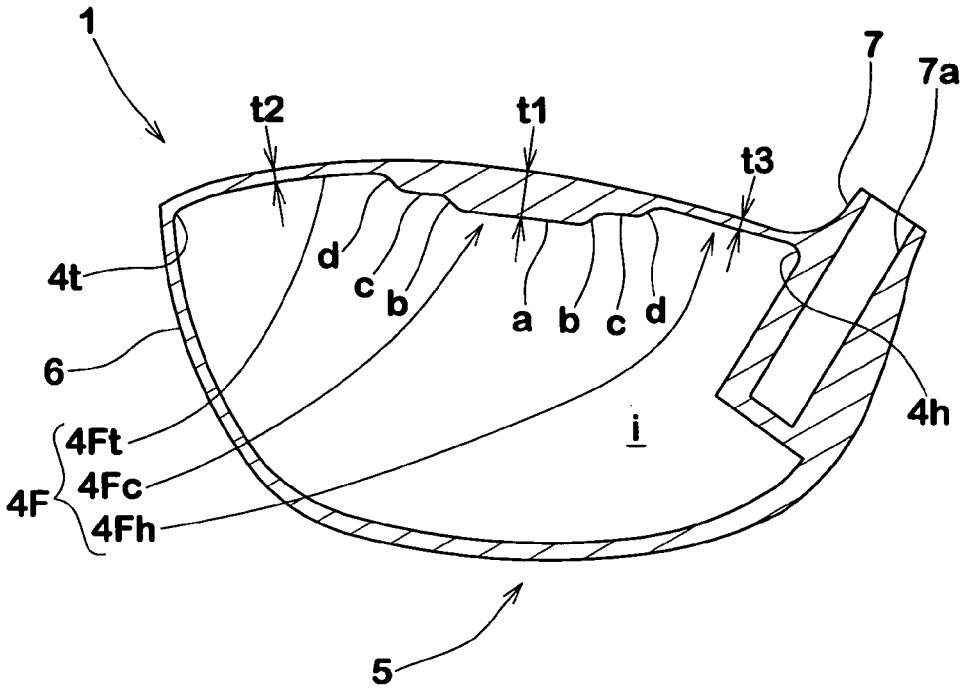
FIGS. 5 and 6 show a second embodiment of the present invention as cross sectional views taken along line A-A and line B-B in FIG. 1, respectively.
Figure 6:
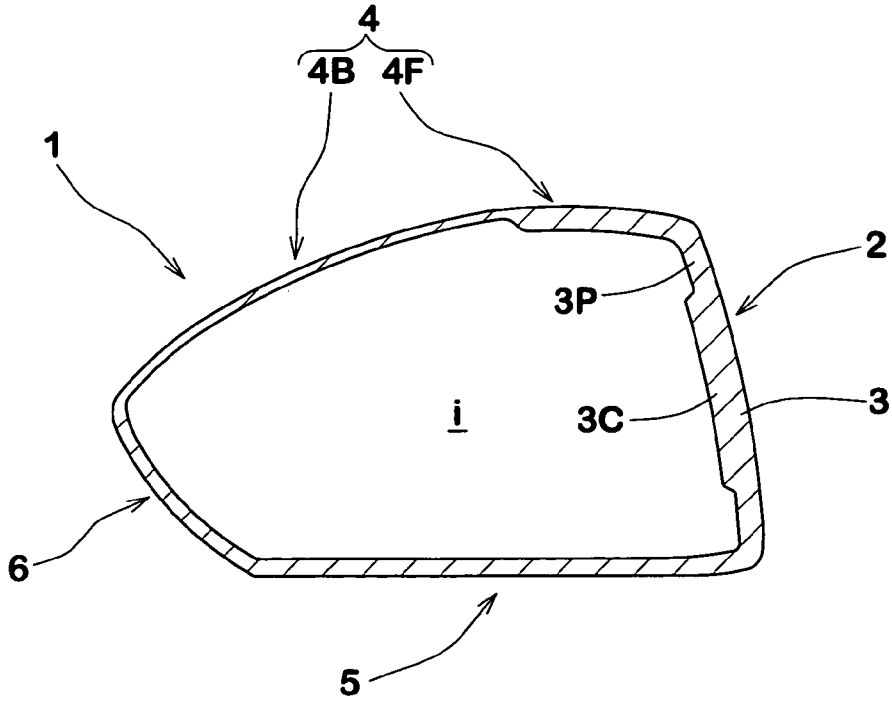

In the embodiment shown in FIGS. 3 and 4 and the embodiment shown in FIGS. 5 and 6, a variable-rigidity face-backing zone 4F is provided in only the crown portion 4.

Figure 7:
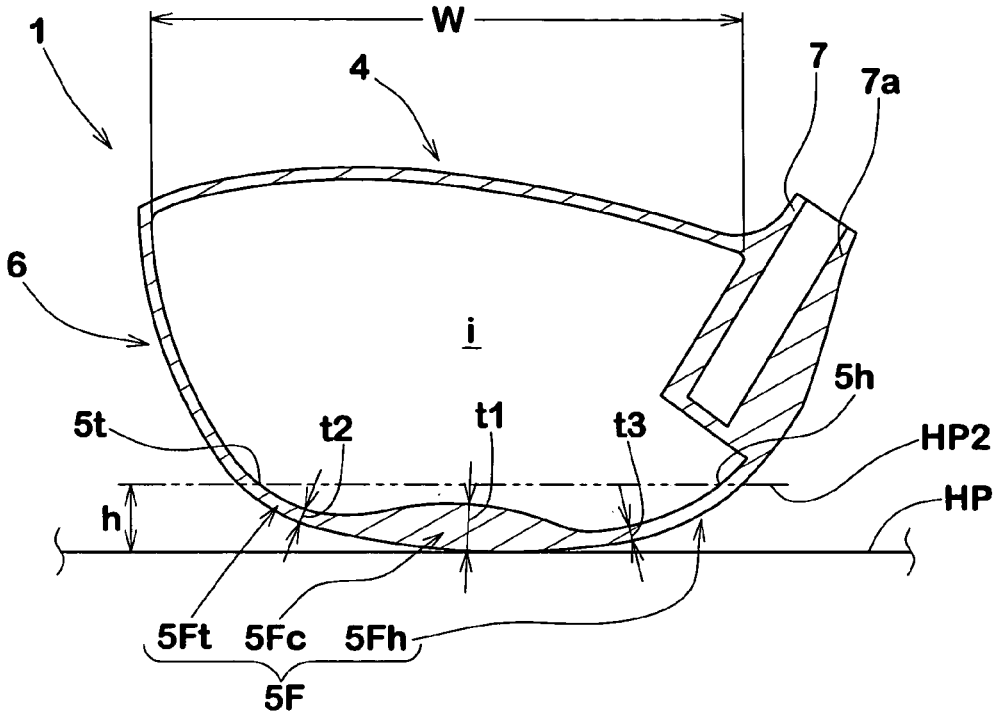
FIGS. 7 and 8 show a third embodiment of the present invention as cross sectional views taken along line A-A and line B-B in FIG. 1, respectively.
Figure 8:
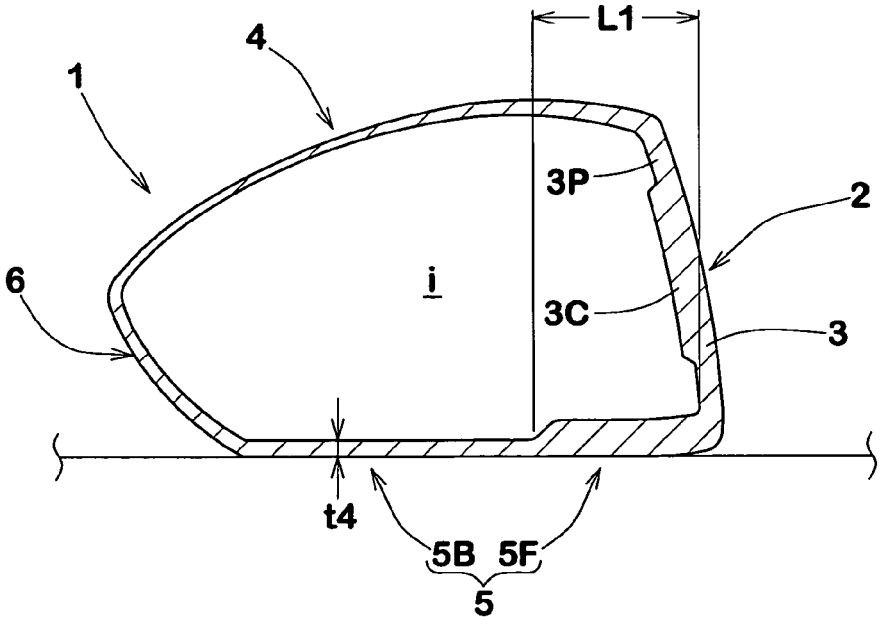
Figure 9:
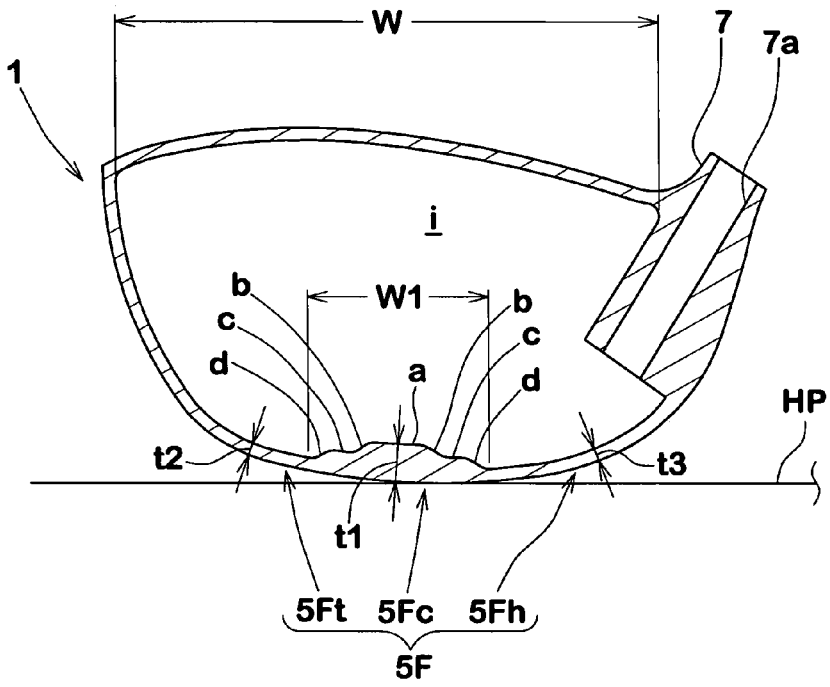
FIGS. 9 and 10 show a fourth embodiment of the present invention as cross sectional views taken along line A-A and line B-B in FIG. 1, respectively.
Figure 10:
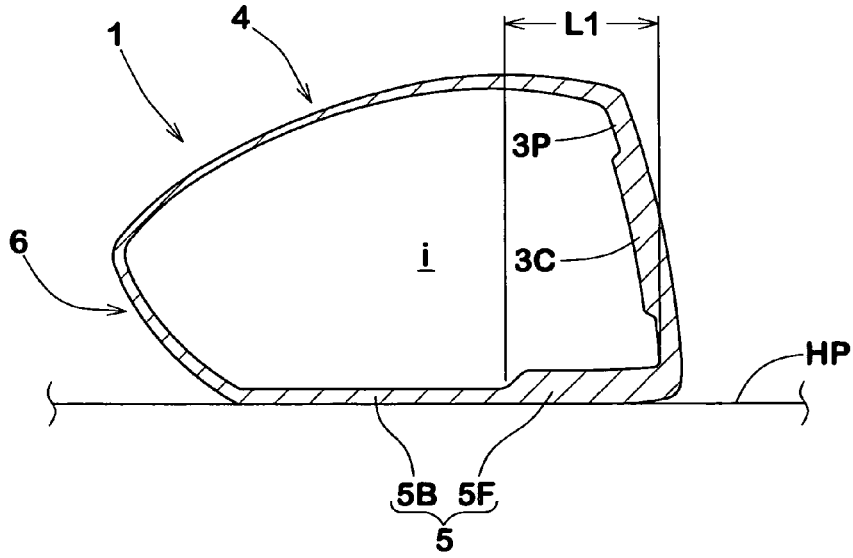

In the embodiment shown in FIGS. 7 and 8 and the embodiment shown in FIGS. 9 and 10, a variable-rigidity face-backing zone 5F is provided in only the sole portion 5.

Figure 11:
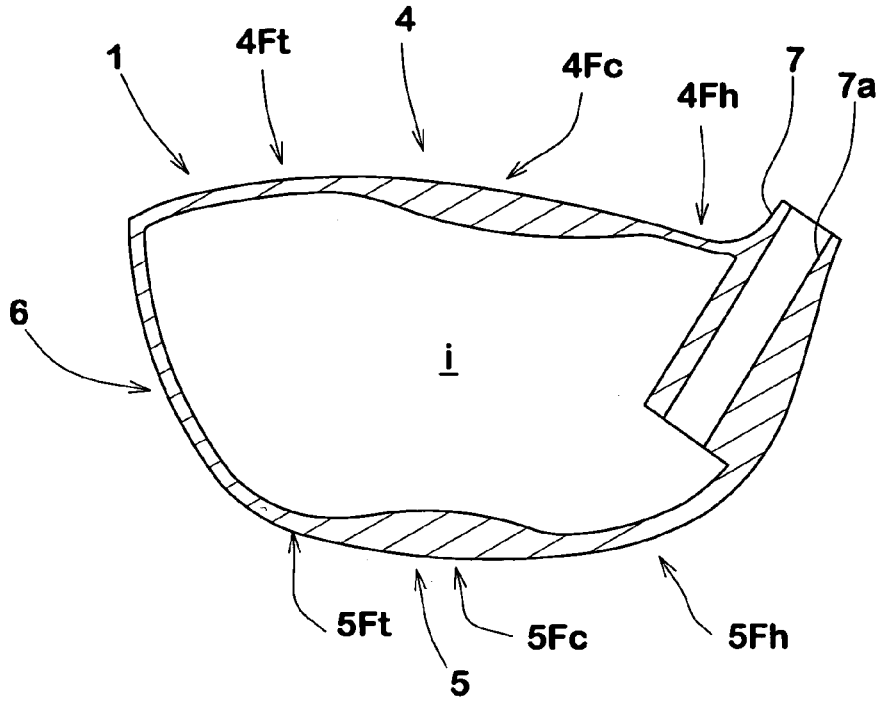
FIGS. 11 and 12 show a fifth embodiment of the present invention as cross sectional views taken along line A-A and line B-B in FIG. 1, respectively.
Figure 12:
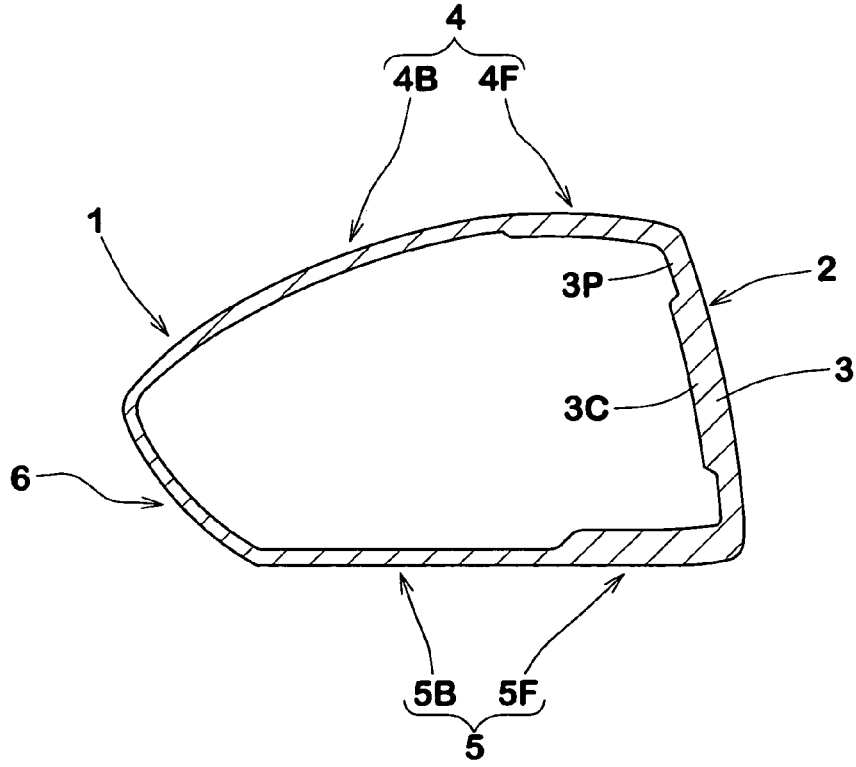

In the embodiment shown in FIGS. 11 and 12, a variable-rigidity face-backing zone 4F and a variable-rigidity face-backing zone 5F are provided in both the crown portion 4 and sole portion 5, respectively.

The variable-rigidity face-backing zone 4F, 5F is a zone provided immediately behind the face portion 3 along the upper edge or lower edge of the club face 2 where the rigidity of the wall is gradually changed in the heel-toe direction such that a central part (4FC, 5FC) has a higher rigidity than other parts including a toe side part (4Ft, 5Ft) and a heel side part (4Fh, 5Fh) and optionally a back side part (4B, 5B).

Such a gradual rigidity variation in the variable-rigidity face-backing zone (4F, 5F) can be achieved by changing the thickness of the material. Also it is possible to utilize a rigidity change caused by thermal treatment in case of metal material. Further, in case of fiber reinforced plastics, the gradual rigidity variation may be obtained by gradually changing the density and/or orientations of the embedded reinforcing fibers and/or using different matrix resins between the central part (4FC, 5FC) and the lateral parts (4Ft, 5Ft and 4Fh, 5Fh).

In the embodiments, changing of the material thickness is utilized as described below because this method is easiest and a steady result can be obtained Such thickness variation is very small to depict, therefore, in the drawings the thickness variation and increased thickness are considerably exaggerated and further not always proportional between different portions.

The face-backing zone (4F, 5F) can be formed over the entirety of the crown portion 4/sole portion 5 from its front edge to rear edge. But, this feature is not always necessary in view of the face-backing effect.

However, if the depth L1 of the face-backing zone (4F, 5F) in the front-rear direction of the head is less than 5% of the entire depth L of the club head, then it becomes difficult to obtain an effective rigidity variation.

Accordingly, in the above-mentioned standard state, the depth L1 of the face-backing zone 4F is set in the range of more than 5%, preferably not less than 8%, more preferably not less than 10% of the club head depth L. More specifically, the depth L1 is more than 10 mm.

In view of weight reduction, it may be preferable that the depth L1 is set in the range of not more than 50%, more preferably not more than 40%, still more preferably not more than 30% of the club head depth L.

Therefore, in all the embodiments herein, a substantially constant thickness part (4B, 5B), namely, a constant-rigidity zone is formed behind the face-backing zone (4F, 5F).

Here, the depth L of the club head is, as shown in FIGS. 1 and 4, defined as the distance in the horizontal direction measured on a vertical plane VP2 between the extreme ends of the head under the standard state. The vertical plane VP2 is perpendicular to the above-mentioned vertical plane VP1 and includes the sweat spot SS.

The depth L1 of the face-backing zone (4F, 5F) is defined as the distance in the horizontal direction measured on the vertical plane VP2 between the front end and rear end thereof under the standard state.

In the illustrated examples shown in FIGS. 3-12, 13(*a*) and 13(*b*), the face-backing zone (4F, 5F) comprises a central increased-thickness part (4Fc, 5Fc), a toe side part (4Ft, 5Ft) and a heel side part (4Fh, 5Fh). The toe side part (4Ft, 5Ft) and heel side part (4Fh, 5Fh) both have substantially constant thicknesses t2 and t3, respectively.

In the central part (4Fc, 5Fc), the thickness thereof is gradually increased towards its center from the thickness t2 at its toe side edge and from the thickness t3 at its heel side edge so as to have a maximum thickness t1.

Therefore, the rigidity is partially increased in the central part (4Fc, 5Fc) as shown in FIG. 1 as a cross-hatched area for example.

The under-defined width W1 of the central part (4Fc, 5Fc) is set in the range of not less than 10%, preferably not less than 15%, more preferably not less than 20%, but not more than 60%, preferably not more than 55%, more preferably not more than 50% of a maximum width w of the club head 1.

Here, the width w1 is defined by a value measured in the toe-heel direction as that of a portion 0.1 mm thicker than the thickness t2 on the toe side and also 0.1 mm thicker than the thickness t3 on the heel side.

The maximum width w is defined by a value measured on the above-mentioned vertical plane VP1, in the toe-heel direction, namely, a direction parallel to the horizontal plane HP, between the toe side end 4*t* and heel side end 4*h* of the crown portion 4 excluding the hosel portion 7 as shown in FIG. 3.

Further, the width W1 is preferably set in the range of not less than 10%, preferably not less than 15%, more preferably not less than 20%, but not more than 60%, preferably not more than 55%, more preferably not more than 50% of the width FW of the face portion 3.

Furthermore, the width W1 is preferably set in the range of not less than 50%, preferably more than 60%, but not more than 100% of the height FH of the face portion 3. The height FH is measured in the vertical direction on the vertical plane VP2.

More specifically, the width W1 is usually set in the range of more than 10 mm, preferably not less than 20 mm, but not more than 60 mm, preferably not more than 50 mm.

The increased-thickness part (4Fc, 5Fc) is formed immediately behind the face portion 3, and in the toe-heel direction of the head, this part is substantially centered on the sweet spot SS such that the distance between the center of the width W1 and the sweet spot SS is less than 10 mm, preferably less than 5 mm, more preferably less than 3 mm.

The ratio (t1/t2) of the maximum thickness t1 to the thickness t2 and the ratio (t1/t3) of the maximum thickness t1 to the thickness t3 are both set in the range of not less than 1.2, preferably not less than 1.4, more preferably not less than 1.5, but not more than 3.0, preferably not more than 2.5.

Face-backing Zone 4F in Crown Portion 4

In the face-backing zone 4F in the crown portion 4, the maximum thickness t1 of the central part 4Fc is set in the range of not less than 0.6 mm, preferably not less than 0.9 mm, more preferably not less than 1.0 mm, but not more than 2.0 mm, preferably not more than 1.5 mm, more preferably not more than 1.2 mm.

The thickness t2 of the toe-side part 4Ft and the thickness t3 of the heel-side part 4Fh are set in the range of not more than 1.5 mm, preferably not more than 1.2 mm, more preferably not more than 1.0 mm, but not less than 0.5 mm, preferably not less than 0.6 mm, more preferably not less than 0.7 mm.

The thickness t2 and the thickness t3 and further the thickness t4 of the back side part 4B are the substantially same and constant thickness. It is however, possible that at least two of these thickness t2, t3 and t4 are different thicknesses.

If the thickness t1 is less than 0.6 mm, it becomes difficult for the central part 4Fc to withstand large stress at impact, and then durability of the club head is liable to deteriorate. If the thickness t1 is more than 2.0 mm, the amount of deflection of the face portion at impact is lessened, and the rebound performance can not be improved.

If the thickness t2, t3 is more than 1.5 mm, again the amount of deflection of the face portion at impact is lessened, and the rebound performance can not be improved. If the thickness t2, t3 is less than 0.5 mm, the durability of the face-backing zone 4F becomes insufficient.

Face-backing Zone 5F in Sole Portion 5

In the face-backing zone 5F in the sole portion 5, the maximum thickness t1 of the central part 5Fc is set in the range of not less than 0.8 mm, preferably not less than 1.0 mm, more preferably not less than 1.2 mm, but not more than 2.0 mm, preferably not more than 1.8 mm, more preferably not more than 1.6 mm.

The thickness t2 of the toe-side part 5Ft and the thickness t3 of the heel-side part 5Fh are set in the range of not more than 1.8 mm, preferably not more than 1.6 mm, but not less than 0.6 mm, preferably not less than 0.8 mm, more preferably not less than 1.0 mm.

Similarly to the crown portion, the thickness t2 and the thickness t3 and further the thickness t4 of the back side part 5B are the substantially same and constant thickness. It is however, possible that at least two of these thickness t2, t3 and t4 are different thicknesses.

If the thickness t1 is less than 0.8 mm, as the central part 5Fc is subjected to large stress at impact, the durability of the club head is liable to deteriorate. If the thickness t1 is more than 2.0 mm, the amount of deflection of the face portion at impact tends to become lessened, and thus the rebound performance can not be improved.

If the thickness t2, t3 is more than 1.8 mm, it becomes difficult to improve the rebound performance. If the thickness t2, t3 is less than 0.6 mm, the durability of the face-backing zone 5F tends to become insufficient.

Face-backing Zones 4F and 5F

In the face-backing zones 4F and 5F, if the ratio (t1/t2), (t1/t3) is less than 1.2, it is difficult to improve the rebound performance and durability together. If the ratio (t1/t2), (t1/t3) is more than 3.0, there is a possibility of unwanted weight increase due to thickening of the central part or insufficient strength due to thinning of the toe-side part and heel-side part.

If the width W1 of the central part (4Fc, 5Fc) is less than 10% of the width W, then the durability deteriorates and the rebound performance can not be improved. If the width W1 is more than 60% of the width W, as the overall rigidity of the face-backing zone (4F, 5F) is excessively increased, the rebound performance deteriorates.

As to the thickness variation in the front-rear direction, as shown in FIGS. 4, 6, 8, 10 and 12, the thickness in each embodiment maintains a substantially constant value from its front end to almost its rear end, and at the rear end, the thickness is decreased to the thickness t4 of the adjacent part 4B.

As to the thickness variation in the toe-heel direction, on the other hand, in the face-backing zone 4F in the embodiment shown in FIG. 3, the face-backing zone 5F in the embodiment shown in FIG. 7, and the face-backing zones 4F and 5F in the embodiment shown in FIG. 11, the thickness makes a smooth change.

In the face-backing zone 4F in the embodiment shown in FIG. 5 and in the face-backing zone 5F in the embodiment shown in FIG. 9, the thickness makes a stepped change.

In any case, the maximum thickness t1 lies in the center in the widthwise direction.

In case of the smooth change, as shown in FIGS. 3, 7 and 11, in any cross section parallel to the above-mentioned vertical plane VP1, the central part (4Fc, 5Fc) has an inner contour whose center part is defined by a slightly curved convex whereas the lateral parts on the toe side and heel side are defined by a slightly curved concave to merge into the inner contours of the toe-side part (4Ft, 5Ft) and heel-side part (4Fh, 5Fh).

In case of the step change, as shown in FIGS. 5 and 9, in a cross section parallel to the above-mentioned vertical plane VP1, the central part (4Fc, 5Fc) has an inner contour made up of two or more steps having a substantially constant thickness and narrow transitional parts each having a variable thickness changing at a substantially constant rate.

In this example, the number of the steps is two, namely, the central part (4Fc, 5Fc) is made up of: a highest step (a) having the thickness t1; a lower first step (c) on each side thereof; transitional parts (b) between the two steps (a) and (c); and transitional parts (d) between the first steps (c) and the adjacent parts (4Ft, 4Fh, 5Ft, 5Fh).

As noted above, the thickness variation and the increased thickness are considerably exaggerated in the drawings, thus the inner contour of the central part (4Fc, 5Fc) is convex on the whole, and the outer contour is also convex. In practice, however, if the outer contour of the central part (4Fc, 5Fc) is curved convexly, there is a possibility that the inner contour is substantially straight as show in FIG. 13(*a*), or yet concave depending on the curvature of the outer contour.

Figure 13A:
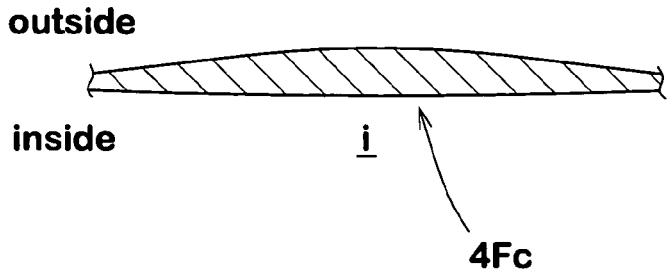
FIGS. 13(*a*) and 13(*b*) are cross sectional views of the variable-rigidity face-backing zone each showing another example of the thickness variation.
Figure 13B:
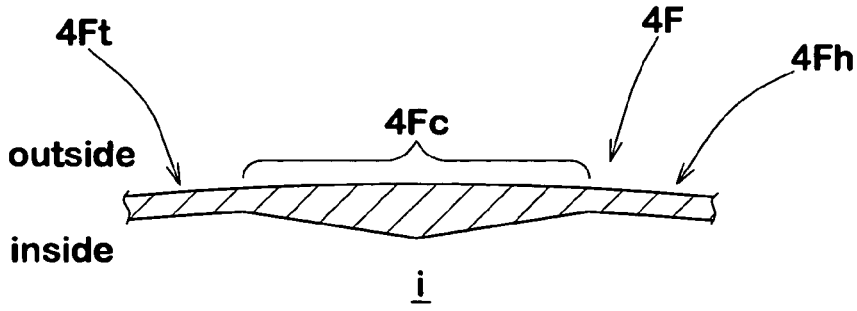

As to the contour of the central increased-thickness part (4Fc, 5Fc), as show in FIG. 13(*b*), a linear contour made up of two straight sides which intersect each other at an angle of near but smaller than 180 degrees forming a vertex, may be used instead of the above-mentioned smooth curve.

In case the face-backing zone 4F is not provided, the crown portion 4 is provided with a substantially constant thickness t4. In case the face-backing zone 5F is not provided, the sole portion 5 may be provided with a substantially constant thickness t4, but it is also possible to vary the thickness in the front-rear direction.

The thickness of the side portion 6 in this example is almost same or slightly smaller than the thickness t1 in the sole portion.

If the border between the sole portion 5 and side portion 6 is unclear but the border is necessary, then, as shown in FIG. 7, the border may be defined by a horizontal plane HP2 at a height (h) of 16 mm from the horizontal plane HP in the standard state. In other words, the sole portion 5 may be defined as a portion lower than 16 mm.

Comparison Tests

Figure 2:
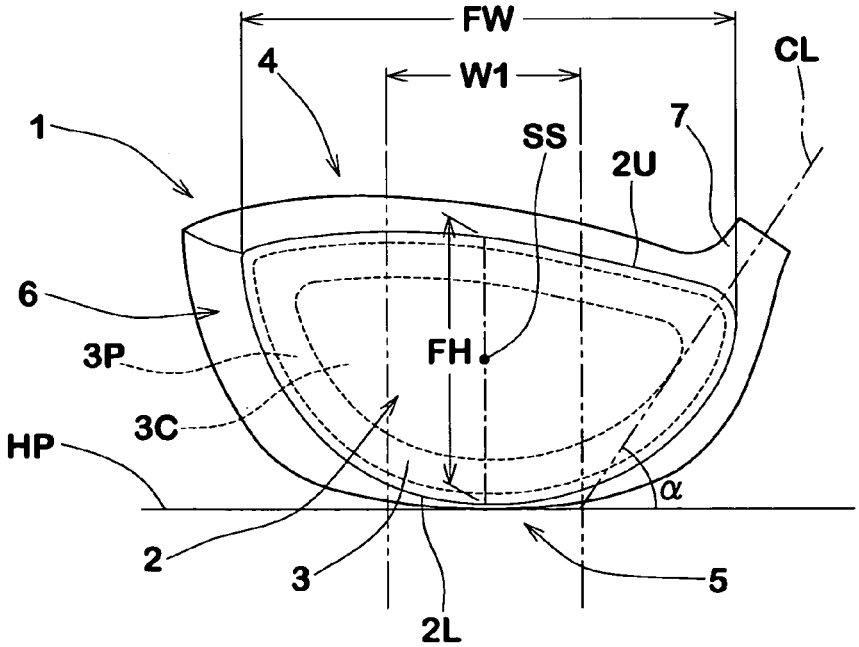
FIG. 2 is a front view thereof.

Metal wood hollow heads having the same outer shape shown in FIGS. 1 and 2 were made changing the structure of the crown portion and sole portion as shown in Table 1, and tested for the restitution coefficient and durability as follows.

Each head was formed by welding a face plate to an open-front hollow main body each made of a titanium alloy Ti-6Al-4V. The head volume was 350 cc, and the weight was 185 grams. The thickness of the face portion was 2.8 mm in the central region 3C and 2.5 mm in the peripheral region 3P. The thickness of the side portion was 1.0 to 1.2 mm.

Restitution Coefficient Test:

According to the "Procedure for Measuring the velocity Ratio of a club Head for conformance to Rule 4-1e, Appendix II, Revision 2 (Feb. 8, 1999), United states Golf Association", the restitution coefficient (e) of each club head was obtained. The results are shown in Table 1. The larger the value, the better the rebound performance.

Durability Test:

The golf club head was attached to an FRP shaft to make a 45-inch wood club. The club was attached to a swing robot and hit golf balls 3000 times at a head speed of 50 m/s and thereafter the head was checked for deformation and/or damage. The test results are shown in Table 1.

TABLE 1

Figure 14:
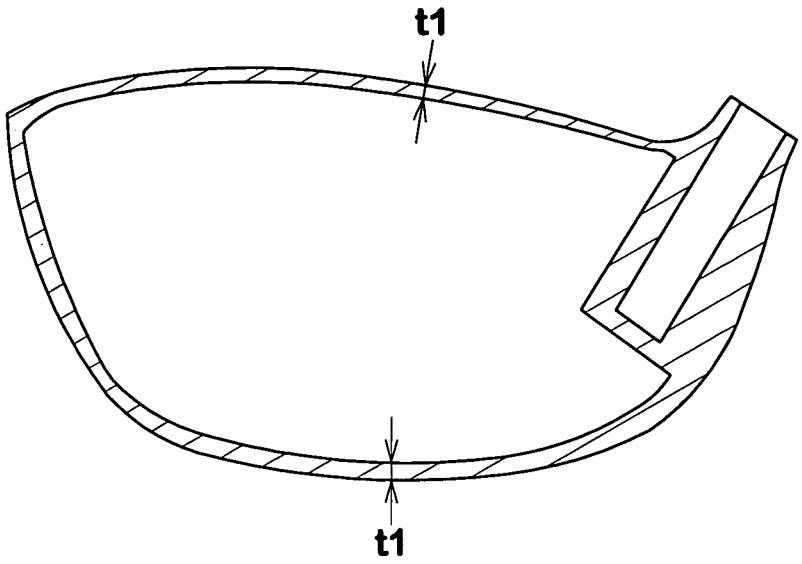
FIGS. 14 and 15 show a golf club head used as "Ref." in the undermentioned comparison tests as cross sectional views taken along lines corresponding to the line A-A and line B-B in FIG. 1, respectively.
Figure 15:
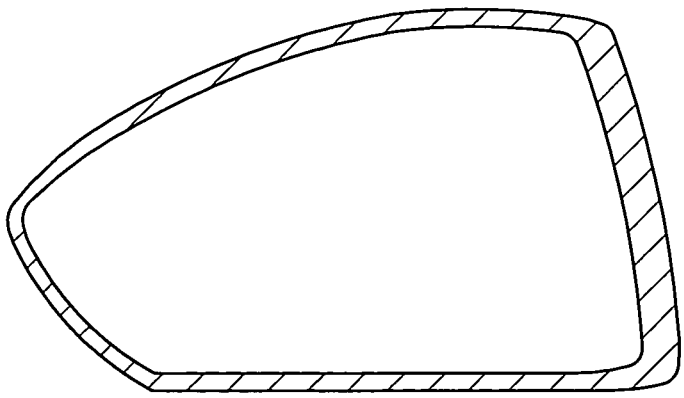

| Club head<br>Structure | Ref. 1<br>FIG. 14<br>FIG. 15 | Ref. 2<br>FIG. 14<br>FIG. 15 | Ex. 1<br>FIG. 3<br>FIG. 4 | Ex. 2<br>FIG. 3<br>FIG. 4 | Ex. 3<br>FIG. 5<br>FIG. 6 | Ex. 4<br>FIG. 5<br>FIG. 6 | Ex. 5<br>FIG. 7<br>FIG. 8 | Ex. 6<br>FIG. 7<br>FIG. 8 | Ex. 7<br>FIG. 9<br>FIG. 10 | Ex. 8<br>FIG. 9<br>FIG. 10 | Ex. 9<br>FIG. 11<br>FIG. 12 |
|---|---|---|---|---|---|---|---|---|---|---|---|
| Crown portion | | | | | | | | | | | |
| t1 (mm) | 1 | 0.7 | 1 | 0.9 | 1 | 0.9 | 1 | 1 | 1 | 1 | 1 |
| t2 = t3 (mm) | 1 | 0.7 | 0.7 | 0.5 | 0.7 | 0.5 | 1 | 1 | 1 | 1 | 0.7 |
| t1/t2 | 1 | 1 | 1.4 | 1.8 | 1.4 | 1.8 | 1 | 1 | 1 | 1 | 1.4 |
| W1/W (%) | — | — | 35 | 35 | 35 | 35 | — | — | — | — | 35 |
| L1/L (%) | — | — | 17 | 11 | 17 | 11 | — | — | — | — | 17 |
| Sole portion | | | | | | | | | | | |
| t1 (mm) | 1.4 | 1.4 | 1.4 | 1.4 | 1.4 | 1.4 | 1.4 | 1.2 | 1.4 | 1.2 | 1.4 |
| t2 = t3 (mm) | 1.4 | 1.4 | 1.4 | 1.4 | 1.4 | 1.4 | 1 | 0.8 | 1 | 0.8 | 1 |
| t1/t2 | 1 | 1 | 1 | 1 | 1 | 1 | 1.4 | 1.5 | 1.4 | 1.5 | 1.4 |
| W1/W (%) | — | — | — | — | — | — | 35 | 35 | 35 | 35 | 35 |
| L1/L (%) | — | — | — | — | — | — | 17 | 11 | 17 | 11 | 17 |
| Restitution coefficient | 0.825 | 0.84 | 0.845 | 0.85 | 0.845 | 0.851 | 0.836 | 0.844 | 0.837 | 0.84 | 0.85 |
| Durability | | | | | | | | | | | |
| No. of impacts | 3000 | 350 | 3000 | 2200 | 3000 | 1900 | 3000 | 1700 | 3000 | 1850 | 3000 |
| Damage | no | yes | no | yes | no | yes | no | yes | no | yes | no |

W = 110 mm, L = 90 mm

From the test results, it was confirmed that the restitution coefficient can be remarkably improved while maintaining durability from a practical standpoint.

The present invention is suitably applied to large-sized hollow heads such as metal wood-type heads, but it may be also applied to various heads such as iron-type heads and patter-type heads as far as the face portion is formed by a thin plate behind which a hollow or cavity is formed almost all over the back face of the face portion.

The invention claimed is:

1. A hollow golf club head comprising:

a face portion having a front face that defines a club face for hitting a ball;

a crown portion intersecting the club face at the upper edge thereof; and a sole portion intersecting the club face at the lower edge thereof, wherein the crown portion is provided along the front edge thereof with a face-backing zone in which the rigidity is gradually increased from its toe-side end and heel-side end toward the center thereof by changing the thickness in the face-backing zone such that the thickness is gradually increased from the toe-side end and heel-side end toward the center thereof, and the maximum thickness t1 occurring in the increased-thickness central part is in a range of not less than 0.6 mm and not more than 2.0 mm, and a minimum thickness t2 and a minimum thickness t3 occurring on the toe-side and the heel-side, respectively, of the increased-thickness central part are in a range of not less than 0.5 mm and not more-than 1.5 mm.

2. A hollow golf club head comprising:

a face portion having a front face that defines a club face for hitting a ball;

a crown portion intersecting the club face at the upper edge thereof; and a sole portion intersecting the club face at the lower edge thereof, wherein the sole portion is provided along the front edge thereof with a face-backing zone in which the rigidity is gradually increased from its toe-side end and heel-side end toward the center thereof by changing the thickness in the face-backing zone such that the thickness is gradually increased from the toe-side end and heel-side end toward the center thereof, and the maximum thickness ti occurring in the increased-thickness central part is in a range of not less than 0.8 mm and not more than 2.0 mm, and a minimum thickness t2 and a minimum thickness t3 occurring on the toe-side and the heel-side, respectively, of the increased-thickness central part are in a range of not less than 0.6 mm and not more than 1.8 mm.

3. The hollow golf club head according to claim 1 or 2, wherein the ratio (t1/t2) of the maximum thickness t1 and the thickness t2 is in a range of from 1.2 to 3.0, and the ratio (t1/t3) of the maximum thickness t1 and the thickness t3 is in a range of from 1.2 to 3.0.

4. The hollow golf club head according to claim 3, wherein a width W1 of said central part in the toe-heel direction is more than 10 mm.

5. The hollow golf club head according to claim 3, wherein a width W1 of said central part in the toe-heel direction is more than 15 mm.

6. The hollow golf club head according to claim 3, wherein a width W1 of said central part in the toe-heel direction is more than 20 mm.

7. The hollow golf club head according to claim 3, wherein a width W1 of said central part in the toe-heel direction is more than 25 mm.

8. The hollow golf club head according to claim 3, wherein a width W1 of said central part in the toe-heel direction is more than 30 mm.

9. The hollow golf club head according to claim 3, wherein the face-backing zone has a depth L1 in a range of from 5 to 50% of the depth L of the club head.

10. The hollow golf club head according to claim 1, wherein the crown portion has a convexly curved even outer surface and an inner surface.

11. The hollow golf club head according to claim 10, wherein said inner surface has, in cross section parallel to the toe-heel direction, a contour made up of a central convex curve and a concave curve on each side thereof, having at least two steps, being straight, having two straight lines intersecting each other at an angle slightly smaller than 180 degrees, or made up of a concave curve.

* * * * *